US012172210B2

(12) United States Patent
Wang et al.

(10) Patent No.: US 12,172,210 B2
(45) Date of Patent: Dec. 24, 2024

(54) SYSTEM OF HIGH-PRESSURE DIE CASTING OF ULTRA-LARGE ALUMINUM CASTINGS

(71) Applicant: GM Global Technology Operations LLC, Detroit, MI (US)

(72) Inventors: Qigui Wang, Rochester Hills, MI (US); Liang Wang, Rochester Hills, MI (US); Daniel J. Wilson, Linden, MI (US); Dale A. Gerard, Warren, MI (US); Devin R. Hess, Clarkston, MI (US); Paul J. Boone, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 86 days.

(21) Appl. No.: 18/045,947

(22) Filed: Oct. 12, 2022

(65) Prior Publication Data

US 2024/0123494 A1 Apr. 18, 2024

(51) Int. Cl.

| | |
|---|---|
| ***B22D 35/04*** | (2006.01) |
| ***B22D 17/08*** | (2006.01) |
| ***B22D 39/02*** | (2006.01) |

(52) U.S. Cl.

CPC ..... *B22D 35/04* (2013.01); *B22D 17/08* (2013.01); *B22D 39/02* (2013.01)

(58) Field of Classification Search

CPC ..... B22D 17/08; B22D 17/10; B22D 35/04; B22D 39/02

USPC ..... 164/113, 284, 303, 312

See application file for complete search history.

(56) References Cited

U.S. PATENT DOCUMENTS 5,775,403 A * 7/1998 Premkumar et al. ..... C04B 41/5155 257/E23.188

2009/0032211 A1* 2/2009 Hanna et al. ..... B22D 17/24 164/148.1

* cited by examiner

*Primary Examiner* — Kevin P Kerns

(74) *Attorney, Agent, or Firm* — Vivacqua Crane, PLLC

(57) ABSTRACT

A high pressure die casting (HPDC) system for casting ultra-large single-piece castings for vehicles. The HPDC system includes a clear feeding path from at least one ingate to a predetermined thicker section of a mold cavity, a last to solidify ingate having an equivalent or larger feeding modulus than the highest feeding modulus of the other ingates, and thermal management elements. The clear feeding path, last to solidify ingate, and thermal management elements ensure sufficient supplemental molten metal flow to the thicker portion of the mold cavity to accommodate for shrinkage of the thicker portion of an ultra large casting during the casting and solidification process.

10 Claims, 5 Drawing Sheets

SYSTEM OF HIGH-PRESSURE DIE CASTING OF ULTRA-LARGE ALUMINUM CASTINGS

INTRODUCTION

The present disclosure relates to ultra-large aluminum die castings, more particularly, to a system of high pressure die casting (HPDC) of ultra-large aluminum components for a vehicle.

High pressure die casting is a metal casting process that is characterized by forcing molten metal under high pressure into a mold cavity having a predetermined shape of a casting. Modern vehicles, especially those of hybrid and electric vehicles, are moving toward simpler vehicle body designs by die casting ultra-large single-piece panels and components that serve as a load bearing structure of the vehicle body. These ultra-large single-piece castings are often referred to as mega-castings or giga-castings due to the huge size of the die casting machines used to make these castings. Ultra-large castings allow vehicle bodies to be lighter and less complex to manufacture by replacing the large number of stamped panels required to form the vehicle body with a single-piece casting. As an example, an ultra-large single-piece casting can have a width of at least 0.8 meter (m), a length of at least 1 m, and a height of at least 0.25 m.

Aluminum-silicon based alloys are typically used in die casting of vehicle body components due to the alloys' lightweight, superior moldability, mass producibility, and high strength. These aluminum-silicon alloy ultra-large single-piece castings can have intricate details and varying thicknesses throughout the sections of the castings. For example, the cross-sectional area across a structural member, such as a rib or a boss, may have a greater thickness than that of the cross-sectional area of the adjacent wall of the casting. During the die casting process, the mold cavity portion defining the thicker sections may require continued supplemental molten metal flow to compensate for the shrinkage of the thicker sections of the castings as the alloy cools and solidifies. However, the surrounding thinner sections of the castings may cool and solidify quicker than the thicker sections, thereby inhibiting or restricting continued molten metal flow into the portion of mold cavity that defines the thicker sections. This may result in the final casting having thicker sections with greater porosity than desired due to the shrinkage.

Thus, while the current systems of die casting ultra-large single piece aluminum components achieve their intended purpose, there is a need for an improved system that enables consistent supplemental molten metal flow to the mold cavity portions that define the thicker sections of the castings during the die casting process.

SUMMARY

According to several aspects, a die casting system is disclosed. The die casting system includes a die mold having an interior surface defining a mold cavity in a predetermined shape of a casting and at least one ingate in fluid connection with the mold cavity. The at least one ingate is configured to direct a molten metal flow into the mold cavity to form the casting. The predetermined shape of the casting includes a first casting feature having a first thickness (T1) and a second casting feature having a second thickness (T2) that is greater than the first thickness (T1). The interior surface further defines a feeding channel extending from the at least one ingate directly to the second casting feature for conveying a portion of the molten metal flow from the ingate to the second casting feature.

In an additional aspect of the present disclosure, the feeding channel includes a volume sized to contain a sufficient reservoir of the molten metal flow to accommodate for shrinkage of the second casting feature during a solidification stage of a casting process. The second feature is one of a boss or a rib.

In another aspect of the present disclosure, the ingate is configured such that the portion of the molten metal flow in the feeding channel solidifies later than a remainder of the casting. The feeding channel defines a channel cavity having a rib shape on the casting.

In another aspect of the present disclosure, the die casting system further includes a plurality of ingates. Each of the ingates includes a feeding modulus, and one of the ingates is a last solidifying ingate having a feeding modulus greater than the feeding modulus of any of the remaining plurality of ingates. The feeding modulus is expressed as:

$$M_f=(t_s/C1)^{C2}$$

Where:

$M_f$ is the feeding modulus;

$t_s$ is local solidification time;

C1 and C2 are material and mold constants;

$$C1 = f(T_{liquidus}, T_{mold}, T_{pour}, L, k, \rho_{metal}, \rho_{mold}, Cp_{mold}, Cp_{metal})$$

$$C1 = \left[\frac{\rho_{metal} * L}{(T_{liquidus} - T_{mold})}\right]^2 \left[\frac{\pi}{4k\rho_{mold}Cp_{mold}}\right]\left[1 + \left(\frac{Cp_{metal}(T_{pour} - T_{liquidus})}{L}\right)^2\right];$$

$$C2\text{: } 0.5 \sim 2/3;$$

$T_{liquidus}$ is the liquidus temperature of cast aluminum alloys, varying from 590 to 620 C;

$T_{mold}$ is the temperature of mold or die, varying from room temperature to 500 C;

$T_{pour}$ is the pouring temperature of liquid aluminum, varying from 650-800 C;

L is the latent heat of aluminum alloys (341-405 KJ/kg);

k is the thermal conductivity of the mold or die steel (~45 W/(mK));

$\rho_{mold}$ is the density of mold (steel: 7.8~8.0 g/cm3);

$Cp_{mold}$ is the specific heat of mold (steel: 0.45-0.47 KJ/Kg); and $Cp_{metal}$ is the specific heat of cast aluminum alloys (0.96-0.98 J/g-° C.).

In another aspect of the present disclosure, the die casting system further includes a plurality of casting sections. Each of the casting sections includes a geometric modulus and a feeding modulus greater than the geometric modulus.

The die casting system further includes at least one thermal control element configured to manage a temperature of the molten metal in the feeding channel. The thermal control element includes at least one of a heater element and an insulation element disposed adjacent to the feeding channel.

According to several aspects, a high pressure die casting system including a mold having an interior surface defining a cavity in a shape of a predetermined casting. The mold is divided into a plurality of mold sections. Each of the mold sections includes at least one ingate configured to direct a molten metal flow into a portion of the cavity within the mold section. At least one of the mold sections includes a feeding channel configured to direct the molten metal flow from the at least one ingate directly to a predetermined feature defined in the portion of the cavity within the mold section.

In an additional aspect of the present disclosure, the high pressure die casting system includes at least one of a heating or a cooling control element in thermal communication with the feeding channel.

According to several aspects, a die casting system including a mold having an interior surface defining a mold cavity having a predetermined shape of a casting and a heating element for selectively heating a predetermined feature of the mold cavity to facilitate a sufficient molten metal flow from the ingate to a predetermined portion of the mold cavity. The predetermined feature of the mold cavity is a feeding channel extending from an ingate to the first feature of the mold cavity.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. The illustrated embodiments are disclosed with reference to the drawings, wherein like numerals indicate corresponding parts throughout the several drawings. The figures are not necessarily to scale, and some features may be exaggerated or minimized to show details of particular features. The specific structural and functional details disclosed are not intended to be interpreted as limiting, but as a representative basis for teaching one skilled in the art as to how to practice the disclosed concepts.

Figure 1:
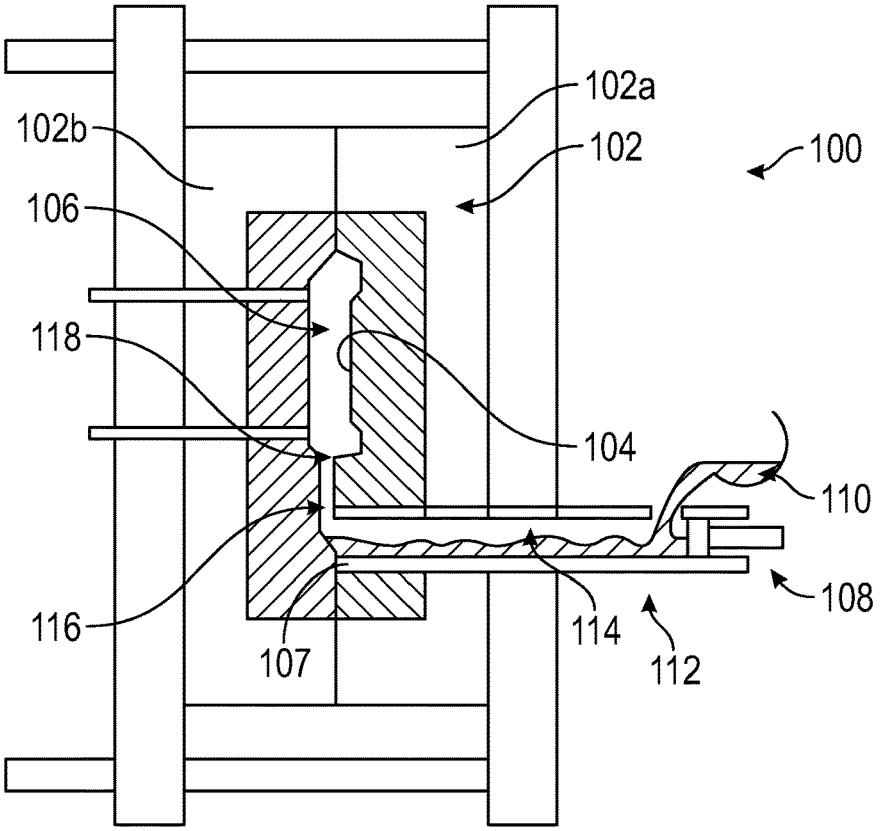
FIG. 1 is a diagrammatic illustration of an exemplary high pressure die casting system.

FIG. 1 shows a diagrammatic illustration of a simplified die casting system 100. The die casting system 100 includes a die casting mold 102 having an internal surface 104 defining a mold cavity 106. The mold cavity 106 is configured to receive a molten metal 107 to form a casting having a predetermined shape of the mold cavity 106. The die casting system 100 further includes a plunger mechanism 108, a pouring mechanism 110, and a shot sleeve system 112 to provide molten metal to the mold cavity 106. The shot sleeve system 112 typically includes a sleeve 114 feeding the molten metal to at least one runner 116, which in turn feeds the molten metal to at least one inner gate 118, also referred to as an ingate 118, which then feeds the molten metal directly into the mold cavity 106. The ingate 118 is in direct fluid communications with the mold cavity 106. For complex shapes, the die casting mold 102 may have multiple strategically positioned ingates 118 to ensure the mold cavity 106 is completely filled with molten metal during the die casting process.

A molten metal, such as a molten aluminum-silicon based alloy 107, is introduced into the sleeve 114 and injected by the plunger mechanism 108 through the runner system into the mold cavity 106. The plunger mechanism 108 is configured to provide a regulated flow of molten metal through the shot sleeve system 112 to fill the mold cavity 106 within a prescribed time and pressure. The molten metal flows from the sleeve 114 through the runner to the ingate 118. The ingate 118 in turn directs the molten metal directly into the mold cavity 106. After the mold cavity 106 is initially filled with the molten metal, supplemental molten metal is continued to be injected into the mold cavity 106 to compensate for shrinkage of the casting as the casting cools and solidifies. The mold 102 is typically formed of two pieces 102*a*, 102*b*, in which one is a stationary piece 102*a* and the other piece 102*b* is a removable piece to facilitate the removal of the solidified casting.

Figure 2:
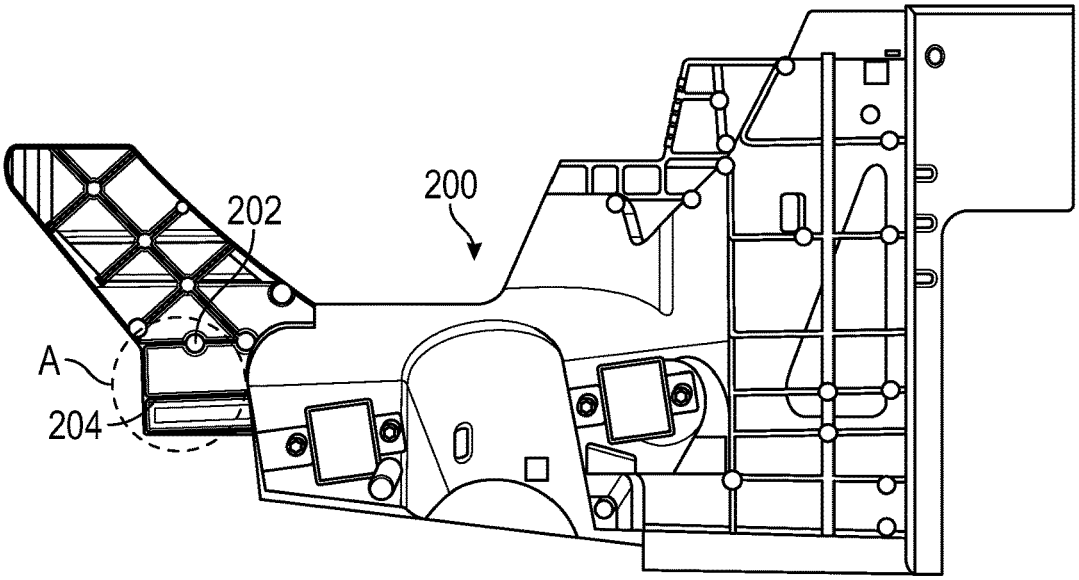
FIG. 2 is a diagrammatic illustration of a plan view of an ultra-large single-piece casting for a vehicle, according to an exemplary embodiment.

FIG. 2 is a diagrammatic illustration of an exemplary ultra-large single-piece casting 200 for a vehicle. For brevity, the ultra-large single-piece casting will be referred to as an ultra-large casting 200 or casting 200 for the purposes of this disclosure. Such ultra-large casting may have dimensions of at least 1.0 m in length, at least 0.8 m in width, and at least 0.25 m in averaged height or thickness. The ultra-large casting 200 is manufactured by casting an aluminum-silicon (Al—Si) based alloy using a 5000 ton or greater capacity die casting press. The molten metal is injected into a reusable 2-piece die at approximately 90 degrees to a parting plane of the 2-piece die under high pressure and high speed. The solidified ultra-large casting 200 is removed from the die, machined to design dimensions and tolerances, and heat treated as necessary to desired specifications.

The ultra-large castings may be designed and manufactured for use on-road vehicles such as passenger car, motorcycles, trucks, sport utility vehicles (SUVs), recreational vehicles (RVs), and off-road vehicles such as marine vessels and aircrafts. Examples of such castings include floorboards, body panels, battery trays, and other load bearing components that have varying thicknesses. The varying thicknesses may be the result of protruding integrally cast structural or load bearing members such as mounting bosses 202 and reinforcement ribs 204.

Figure 3:
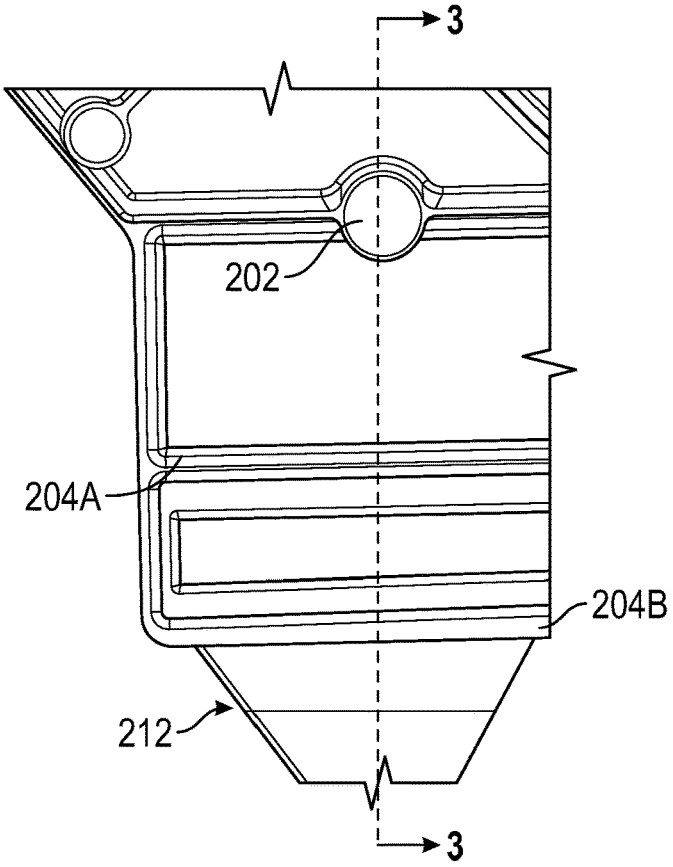
FIG. 3 is a diagrammatic illustration of a detailed Region-A of the ultra-large single-piece casting of FIG. 2, according to an exemplary embodiment.
Figure 4:
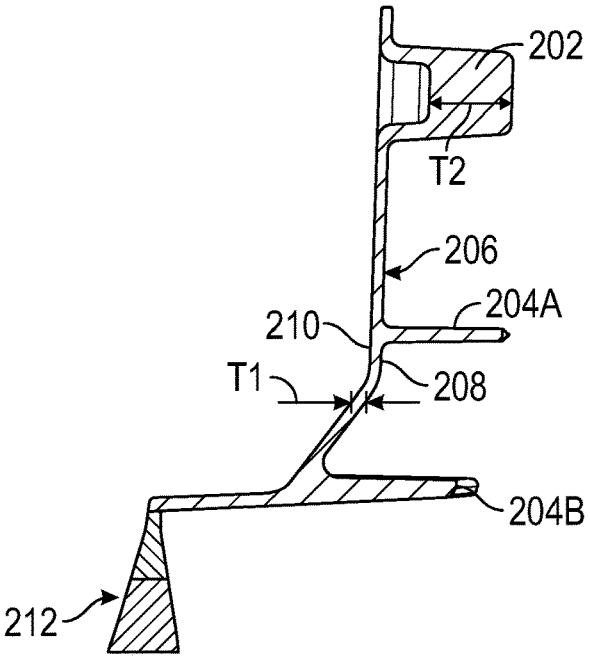
FIG. 4 is a diagrammatic illustration of a cross-sectional view across line 3-3 of FIG. 3, according to an exemplary embodiment.

FIG. 3 is a detailed view of the Region-A of FIG. 2. FIG. 4 is a cross-sectional view across line 3-3 of the casting of FIG. 3. In the embodiment shown, the protuberant feature is that of a boss 202 and a plurality of ribs 204A, 204B extending from a wall 206 of the casting. The boss 202, ribs 204A, 204B, and wall 206 are integrally die-cast as a single-piece unitary structure. The cross-sectional area of the ultra-large casting has a substantially uniform wall thickness (T1) between an outer surface 208 and an opposite facing inner surface 210. The cross-sectional area of the boss 202 includes a boss thickness (T2) greater than the wall thickness (T1). The casting is formed by injecting a molten metal into the cavity of the die that via an ingate. The ingate is represented by a solidified portion 212 taking the form of the ingate as shown in FIGS. 3 and 4.

Most metals are less dense as a liquid than as a solid, therefore the castings may shrink upon cooling as the molten metal solidifies. The thicker portions of the casting, such as the boss 202, shrink proportionally greater than the comparatively thinner portions of the casting, such as the wall 206. To account for non-desirable formation of porosity due to shrinkage of the casting during the cooling and solidification stage, a continual supply of molten material needs to flow into volume of the mold cavity that defines the thicker sections. Otherwise, undesirable porosity or even cavities may appear inside the casting of the thicker sections.

In the exemplary casting 200 shown, during the die casting operation, molten metal flows from the ingate 212 into a portion of the mold cavity that defines the wall section 206 and continues to a portion of the mold cavity that defines the boss 202. During the casting process, the molten metal may initially freeze at the portion of the mold cavity defining the thinner wall section 206, ingates 212, and/or other parts of the mold cavity leading to the portion of the mold cavity that defines the boss 202, thereby inhibiting continual molten metal to flow to the boss 202 section to compensate for shrinkage.

Figure 5:
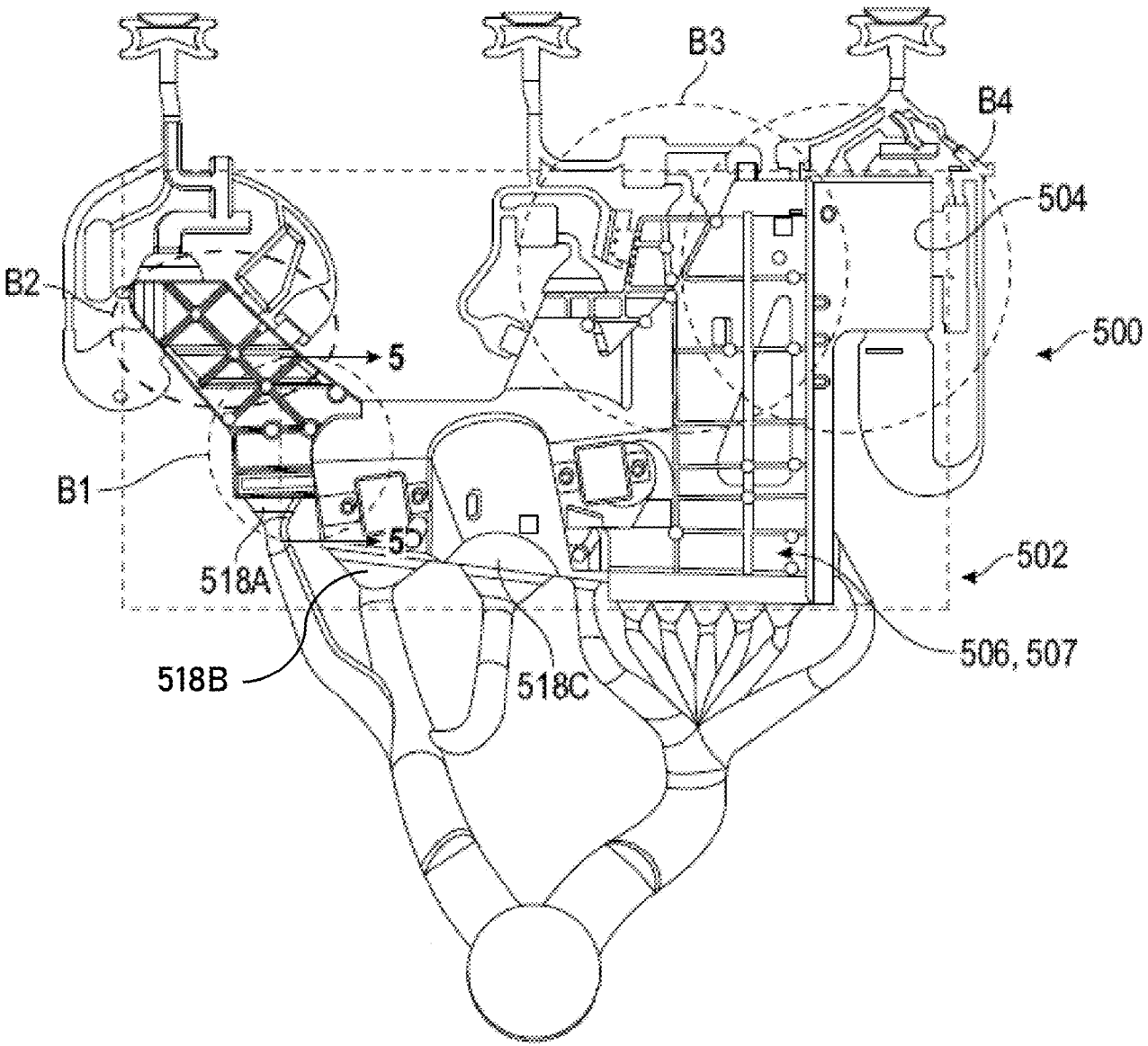
FIG. 5 is a diagrammatic illustration of a high pressure die casting system for making an ultra-large single-piece casting, according to an exemplary embodiment.
Figure 6:
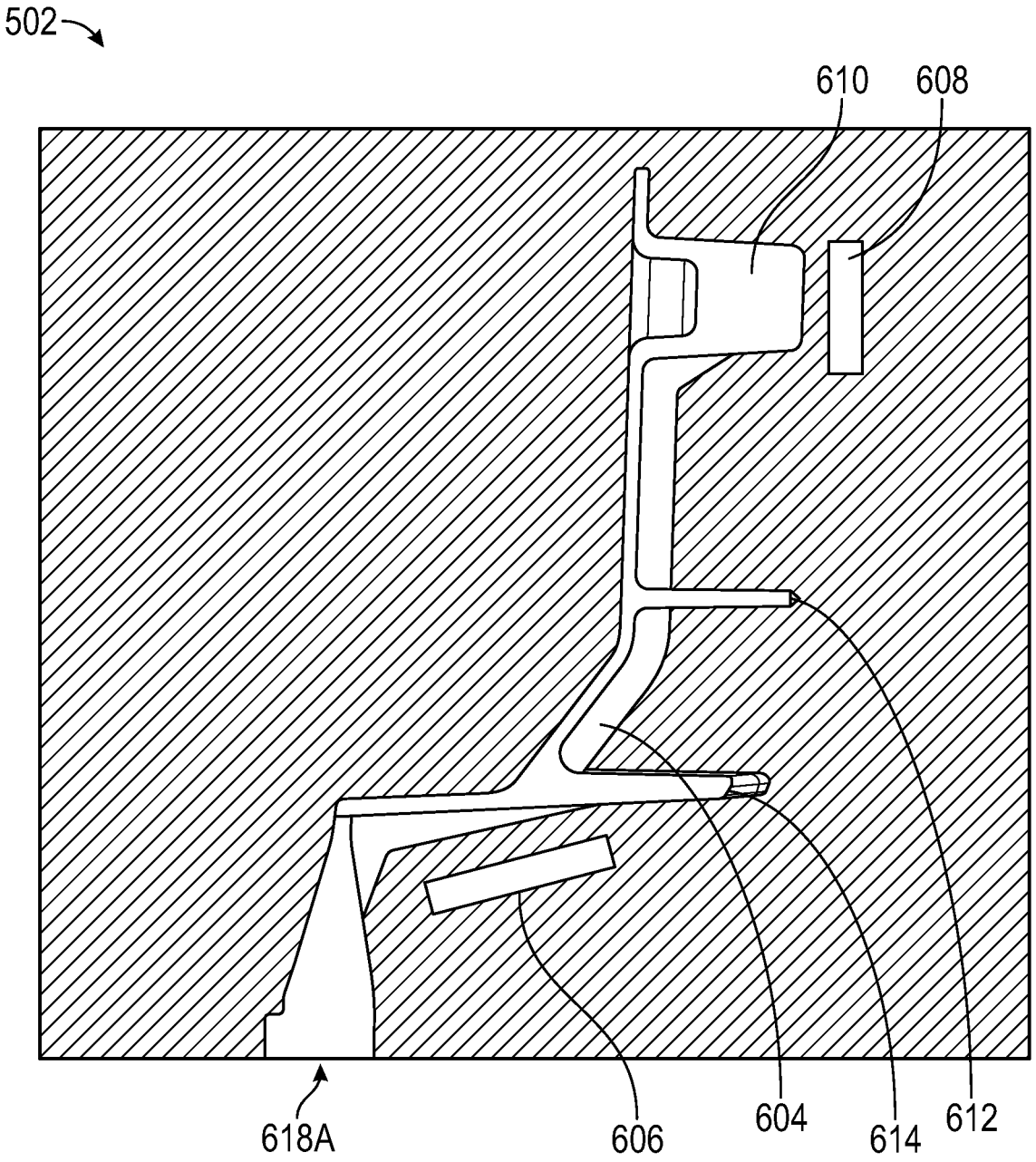
FIG. 6 is a schematic illustration of a cross-sectional view across line 5-5 of the high pressure die casting system of FIG. 5, according to an exemplary embodiment.

FIG. 5 shows a schematic illustration of an exemplary high pressure die casting (HPDC) system 500 for casting ultra-large single-piece castings for vehicles. FIG. 6 is a schematic illustration of a cross-sectional view across line 5-5 of the HPDC system 500 of FIG. 5. The HPDC system 500 includes a clear feeding path 604 extending from at least one ingate 518A, 518B, 518C to thicker sections of the mold cavity, a last to solidify ingate 518A having an equivalent or larger feeding modulus than the highest feeding modulus of the other ingates, and thermal management elements 606, 608. The clear feeding path 604, last to solidify ingate 618A, and thermal management elements 606, 608 ensure sufficient supplemental molten metal flow to the thicker portions of the mold cavity to accommodate for shrinkage of the thicker portions of an ultra large casting during the casting and solidification process.

Referring to FIG. 5, the HPDC system 500 includes a die casting mold 502 (represented by the dashed lines) having an internal surface 504. The internal surface 504 includes protruding details and cavities to define a mold cavity 506 having a predetermined shape and geometry for forming the desired contours and features of a cast component for a vehicle. For example, such protruding details and cavities can form walls and structural elements such as bosses 610 and ribs 612, 614. In other words, the shape of the mold cavity is a negative impression of the shape of the predetermined casting.

For clarity of illustration and disclosure, the HPDC system 500 is shown with a solidified casting 507 occupying the mold cavity 506. The die casting mold 502 is partitioned into a plurality of predetermined casting sections B1, B2, B3, B4, which may overlap one another. Examples of predetermined casting sections are represented by the dashed circles indicated by reference letters B1, B2, B3, B4. At least one ingate 518A, 518B, 518C is provided for each of the casting sections B1, B2, B3, B4, to ensure the complete filling of a portion of the mold cavity within that casting section. As an example, referring to casting section B1, the casting section B1 is provided with ingate 518A.

The ingates 518A, 518B, 518C are configured to ensure that molten metal flow is proportional to the volume of the mold cavity for a given casting section to ensure that the molten metal completely fills that volume of the mold cavity. The total number of ingates 518A, 518B, 518C should be sufficient such that the distance between ingates, and any volume in the mold cavity that is filled by an ingate 518A, 518B, 518C, is smaller than the distance of the molten metal fluidity. One of the ingates 518A in the casting system is configured to be solidified more slowly than any of the other ingates 518A, 518B, 518C. The last solidifying 518A ingate maybe achieved by geometry, die thermal management, or both.

FIG. 6 is a cross-sectional view across line 5-5 in the casting section B1 of the HPDC system of FIG. 5. The casting section B1 includes a clear feeding channel 604, thermal management elements 606, 608 and an ingate 618A designed to ensure a continuous sufficient supply of molten metal to the thicker portions 610, 612, 614 of the mold cavity 506 to accommodate casting shrinkage in these thicker portions 610, 612, 614 during the casting process. In this particular example, the thicker portions shown is that of a cross sectional area of a boss 610 and ribs 612, 614.

The feeding channel 604 is configured so that the feed metal is liquid at the time that it is required, which means that the molten metal within the feeding channel 604 solidifies later than the remainder of the casting, including the thicker sections. The feeding channel 604 must also contain sufficient volume of metal, liquid at the time it is required, to satisfy the shrinkage demands of the thicker sections. In the embodiment shown, the feeding channel 604 directly connecting the ingate 618A to the thicker sections 610, 612, 614 of the mold cavity to facilitate adequate molten metal flow to these thicker sections during the initial filling process. The feeding channel 604 is sized to contain a reservoir of molten metal after the mold cavity is initially filled. The volume of the reservoir of molten metal contained in the feeding channel 604 is sufficient to supply the portion of the mold cavity that defines the thicker sections of the casting after the initial filling of the mold cavity.

Figure 7:
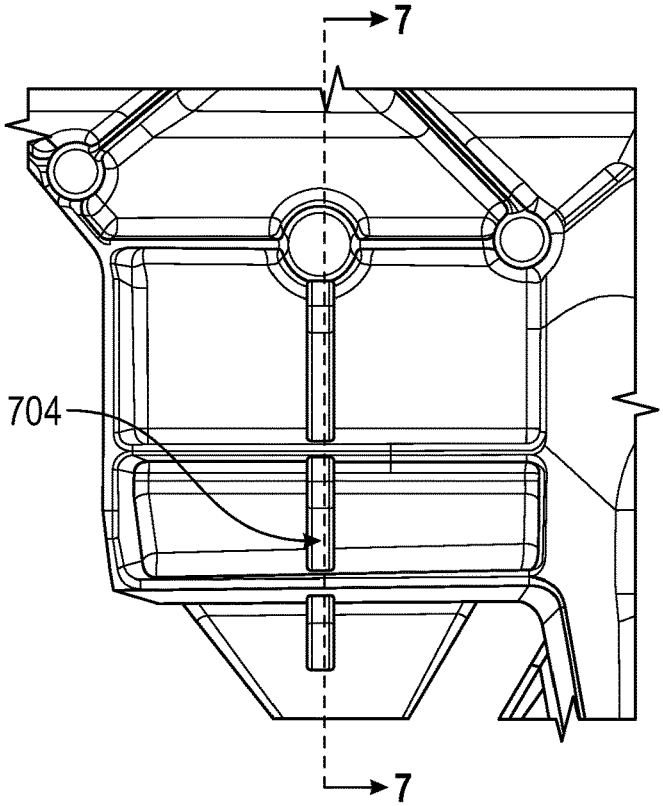
FIG. 7 is a diagrammatic illustration of a detailed Region-B1 of the ultra-large single-piece casting of FIG. 5, according to an exemplary embodiment.
Figure 8:
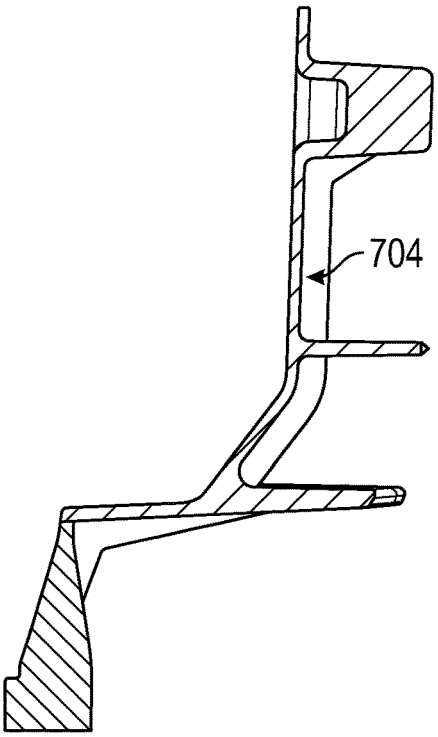
FIG. 8 is a diagrammatic illustration of a cross-sectional view across line 7-7 of FIG. 7, according to an exemplary embodiment.

FIG. 7 is a detailed view of Region-B1 of the ultra-large single-piece casting of FIG. 5. FIG. 8 is a cross-sectional area of the detailed view alone line 7-7 in FIG. 7. The feeding channel 604 offers several benefits in which includes facilitating molten metal flow to the portions of the mold cavity that define the thicker sections. Once the casting is solidified, the solidified metal remaining in the feeding channel 604 forms a supporting rib 704 on the casting for additional strength. Alternatively, the excess solidified metal may be machined off.

The ingate 618A is configured so that the feed metal in the feeding channel 604 is liquid at the time that it is needed, which means that the molten metal in the feeding channel 604 must solidify later than the casting itself. The die casting system 500 provides an ingate 618A with an equivalent or larger feeding modulus than any of the other feeding modulus in the casting mold. The larger feeding modulus enables the ingate to be the last to solidify, thus enabling the portion of the mold cavity that the ingate feeds to be completely filled by molten metal. The feeding modulus (Mf) is a function of local solidification time which is a combined result of the local geometric modulus (Mc) and thermal condition. The feeding modulus (Mf) is calculated for each of the predetermined casting sections. The feeding modulus is expressed as:

$$M_f=(t_s/C1)^{C2}$$

Where:

Mf is the feeding modulus;

$t_s$ is local solidification time;

C1 and C2 are material and mold constants;

$$C1 = f(T_{liquidus}, T_{mold}, T_{pour}, L, k, \rho_{metal}, \rho_{mold}, Cp_{mold}, Cp_{metal})$$

$$C1 = \left[\frac{\rho_{metal} * L}{(T_{liquidus} - T_{mold})}\right]^2 \left[\frac{\pi}{4k\rho_{mold}Cp_{mold}}\right]\left[1 + \left(\frac{Cp_{metal}(T_{pour} - T_{liquidus})}{L}\right)^2\right];$$

$$C2: 0.5 \sim 2/3;$$

$T_{liquidus}$ is the liquidus temperature of cast aluminum alloys, varying from 590 to 620 C;

$T_{mold}$ is the temperature of mold or die, varying from room temperature to 5000;

$T_{pour}$ is the pouring temperature of liquid aluminum, varying from 650-8000;

L is the latent heat of aluminum alloys (341-405 kJ/kg);

k is the thermal conductivity of the mold or die steel (~45 W/(mK));

$\rho_{mold}$ is the density of mold (steel: 7.8~8.0 g/cm3);

$Cp_{mold}$ is the specific heat of mold (steel: 0.45-0.47 KJ/Kg); and $Cp_{metal}$ is the specific of cast aluminum alloys (0.96-0.98 J/g-° C.).

A geometric modulus is calculated for each of the predetermined casting sections. The geometric modulus (Mc) may be expressed in units of length.

$$Mc = Vc/Ac$$

where:

Vc is the volume of the casting section; and

Ac is the surface area of the casting section actually in direct contact with the material of the mold.

Referring back to FIG. 6, the die casting system 500 further includes thermal management elements 606, 608 for selectively heating and/or cooling predetermined sections of the die mold to facilitate sufficient molten metal flow to the thicker portions of the mold cavity. The thermal management elements include one or more of insulation coating applied locally to reduce heat loss, localized heating elements such as electric resistance, and/or application of infrared heat to delay the solidification rate of the molten metal in the mold cavity leading to the thicker sections of the die portion. Cooling elements may be positioned proximal to the thicker sections to remove heat to increase the rate of solidification shrinkage of the thicker sections thus allowing supplemental molten metal flow to the thicker sections as the remainder of the mold cavity is filled.

In high pressure die casting, high pressure is applied to the liquid metal in the cavity during its solidification. Pressurization during solidification is called solidification intensification. The above disclosed die casting system maximizes the benefits of solidification intensification of HPDC. The casting system enables the production of high quality and high integrity ultra-large castings with predictable and desired mechanical properties as well as minimal distortion. The casting system improves performance and reliability of ultra-large lightweight aluminum castings.

The description of the present disclosure is merely exemplary in nature and variations that do not depart from the general sense of the present disclosure are intended to be within the scope of the present disclosure. Such variations are not to be regarded as a departure from the spirit and scope of the present disclosure.

What is claimed is:

1. A die casting system comprising:

a die mold including an interior surface defining a mold cavity having a predetermined shape of a casting; and at least one ingate in fluid connection with the mold cavity, wherein the at least one ingate is configured to direct a molten metal flow into the mold cavity to form the casting;

wherein the predetermined shape of the casting includes a first casting feature having a first thickness (T1) and a second casting feature having a second thickness (T2);

wherein the second thickness (T2) is greater than the first thickness (T1);

wherein the interior surface further defines a feeding channel extending from the at least one ingate directly to the second casting feature for conveying a portion of the molten metal flow from the at least one ingate to the second casting feature;

wherein the feeding channel is sized to contain a reservoir of molten metal configured to:

feed the second casting feature to compensate for shrinkage of the second casting feature during a solidification stage of a casting process, and form a support rib.

2. The die casting system of claim 1, wherein the second casting feature is one of a boss and a rib.

3. The die casting system of claim 1, wherein the at least one ingate includes a last to solidify ingate; and wherein the feeding channel extends from the last to solidify ingate directly to the second casting feature.

4. The die casting system of claim 1, further comprising a plurality of ingates;

wherein each of the ingates includes a feeding modulus, wherein one of the plurality of ingates is a last solidifying ingate, and wherein the feeding modulus of the last solidifying ingate is greater than the feeding modulus of any of a remaining plurality of ingates.

5. The die casting system of claim 4, wherein at least one of the feeding modulus is expressed as:

$$M_f = (t_s/C1)^{C2}$$

Where:

$M_f$—feeding modulus;

$t_s$—local solidification time;

C1 and C2—material and mold constants;

$$C1 = f(T_{liquidus}, T_{mold}, T_{pour}, L, k, \rho_{metal}, \rho_{mold}, Cp_{mold}, Cp_{metal})$$

$$C1 = \left[\frac{\rho_{metal} * L}{(T_{liquidus} - T_{mold})}\right]^2 \left[\frac{\pi}{4k\rho_{mold}Cp_{mold}}\right]\left[1 + \left(\frac{Cp_{metal}(T_{pour} - T_{liquidus})}{L}\right)^2\right];$$

$$C2: 0.5 \sim 2/3;$$

$T_{liquidus}$—liquidus temperature of cast aluminum alloys, varying from 590 to 620° C.;

$T_{mold}$—temperature of mold, varying from room temperature to 500° C.;

$T_{pour}$—pouring temperature of liquid aluminum, varying from 650-800° C.;

L—latent heat of aluminum alloys (341-405 KJ/kg);

k—thermal conductivity of the mold (~45 W/(mK));

$\rho_{mold}$—density of mold (steel: 7.8~8.0 g/cm3);

$Cp_{mold}$—specific heat of mold (steel: 0.45-0.47 KJ/Kg); and $Cp_{metal}$—specific heat of cast aluminum alloys (0.96-0.98 J/g-° C.).

6. The die casting system of claim 1, further comprising a plurality of casting sections, wherein each of the casting sections includes a respective geometric modulus and a respective feeding modulus greater than the respective geometric modulus.

7. The die casting system of claim 1, further comprising at least one thermal control element configured to manage a temperature of the molten metal in the feeding channel.

8. The die casting system of claim 7, wherein the at least one thermal control element includes at least one of a heater element and an insulation element disposed adjacent to the feeding channel.

9. The die casting system of claim 1, wherein the feeding channel defines a channel cavity having a rib shape on an external surface of the casting.

10. The die casting system of claim 1, wherein the second casting feature is a boss.

* * * * *